US007160155B2

(12) United States Patent
Sanftleben et al.

(10) Patent No.: US 7,160,155 B2
(45) Date of Patent: Jan. 9, 2007

(54) DEVICE FOR ELECTRICAL CONNECTION WITH CONTACT PINS PROTRUDING FROM AN AXIAL OPENING

(75) Inventors: Emanuel Sanftleben, Geisling (DE); Marcus Unruh, Zeitlarn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/015,371

(22) Filed: Dec. 17, 2004

(65) Prior Publication Data

US 2006/0040537 A1 Feb. 23, 2006

Related U.S. Application Data

(60) Provisional application No. 60/603,330, filed on Aug. 20, 2004.

(30) Foreign Application Priority Data

Aug. 20, 2004 (DE) ..... 10 2004 040 486
Nov. 25, 2004 (EP) ..... 04106075

(51) Int. Cl.
*H01R 13/64* (2006.01)

(52) U.S. Cl. ..... 439/680

(58) Field of Classification Search ..... 439/278, 439/282, 130, 680; 239/102.2, 88, 533.2; 123/205, 296

See application file for complete search history.

(56) References Cited

U.S. PATENT DOCUMENTS 4,059,324 A * 11/1977 Snyder et al. ..... 439/321
4,150,866 A * 4/1979 Snyder et al. ..... 439/275
5,295,866 A * 3/1994 Kroger et al. ..... 439/589
5,641,310 A * 6/1997 Tiberio, Jr. ..... 439/680

FOREIGN PATENT DOCUMENTS

DE 19715487 A1 10/1998
DE 19844743 C1 6/2000
WO 9847188 10/1998

* cited by examiner

*Primary Examiner*—Chandrika Prasad
(74) *Attorney, Agent, or Firm*—Baker Botts L.L.P.

(57) ABSTRACT

A device (10) has a contact surface (22) arranged laterally offset and essentially extending tangentially in relation to an insertion section (16), which, on introduction of the insertion section (16) into a housing opening, interoperates with a corresponding contact surface of the housing providing torsional stability, with the contact surface (22) of the connecting device (10) being embodied at areas of the contact surface tangentially opposite one another in each case with a plastic deformable contact surface projection (24) and/or the circumferential area of the insertion section having an annular closed area of the cylindrical surface on which a number of elastic, sprung, centering projections (20), projecting radially from the area of the cylindrical surface are provided which are arranged at intervals from one another around the circumference. This makes possible a functionally-optimized and tight-fitting interoperation between the corresponding contact surfaces.

11 Claims, 3 Drawing Sheets

DEVICE FOR ELECTRICAL CONNECTION WITH CONTACT PINS PROTRUDING FROM AN AXIAL OPENING

PRIORITY

This application claims priority to U.S. Provisional Application 60/603,330 filed Aug. 20, 2004; German Application No. 10 2004 040 486.0 filed on Aug. 20, 2004 and European Application No. 04106075.7 filed Nov. 25, 2004.

TECHNICAL FIELD OF THE INVENTION

This invention relates to a device for the electrical connection of contact pins with the terminal pins of a connector embodied by the device. In addition, the invention relates to the use of such a connecting device.

DESCRIPTION OF THE RELATED ART

Such a connecting device in the form of a contact plate fitted onto two contact pins of a piezoelectric actuator is known from DE 197 15 487 A1. The known contact plate is made of an insulating plastic and is provided with openings for the projecting contact pins to pass through which are almost parallel to the longitudinal direction of the actuator. As a result, in the inside of the contact plate in each case, taking a contacting device at an opening as a starting basis, electrical lines are routed to the terminal pins which protrude laterally from the contact plate. By encapsulating an upper part of an actuator housing as well as the contact pins with the fitted and connected contact plate, a connector housing is embodied, in which case the laterally projecting terminal pins protrude into a terminal chamber so that a connector is embodied at this location by means of which the piezoelectric actuator can be connected to an external line arrangement.

Likewise, from DE 198 44 743 C1 a connecting device, in the form of a contact tongue carrier, is known. The known contact tongue carrier serves to seal and position the contact pins of a piezoactuator for the injection valve of an internal combustion engine and has a plastic body with openings for the contact pins to pass through. After the contact tongue carrier has been fitted onto the contact pins of the piezoactuator, the ends of the contact pins protruding from the openings come into contact with the solder tags forming an integral part of the plastic body and can be soldered onto these. As a result, the solder tags are connected electrically to laterally projecting contact tongues which serve as the terminal pins of a connector embodied by a plastic coating.

Establishing an electrical connection by means of the known connecting devices is problematical in so far as these devices are often not in an exactly defined position once fitted and, therefore, it is often necessary for them to also be adjusted manually. Without such an adjustment of the position and orientation of the connecting device, the electrical contacting of the contact pins is adversely affected. In addition, for a subsequent encapsulation of the connecting device (in the case of insufficient position accuracy) there is the further risk that coating material passes through the clearance in an undesired way, which in the case of an exactly defined position of the connecting device would be considerably smaller and therefore seal the opening.

SUMMARY OF THE INVENTION

It is thus the object of this invention to provide a connecting device of the type mentioned above, in which a relatively exactly-defined position of the connecting device relative to a housing is guaranteed in a simple way.

According to the invention, a connecting device is provided for the electrical connection of contact pins which protrude from an axial opening of a sleeve-type housing, with terminal pins of a connector, embodied by the device including a device body with an insertion section which is suitably embodied for the axial intervention in the opening and is provided with openings for the contact pins to pass through and with, referring to the insertion section, a contact surface arranged laterally displaced and, in essence, extending tangentially which, on inserting the insertion section into the opening, interoperates with a corresponding contact surface of the housing to provided torsional stability, with the contact surface of the connecting device referring to the insertion section is embodied tangentially to contact surface areas that are opposite one another in each case with a plastic deformable contact surface projection and/or, in which case, the circumferential area of the insertion section has a circularly closed area of the cylindrical surface on which several elastic, springy, centering projections, projecting radially from the area of the cylindrical surface are provided which are arranged at intervals from one another in the circumferential direction.

It is initially important for the connection body to have an insertion section for axial engagement into an axial opening of a housing. This advantageously already brings about a certain "rough adjustment" of the position of the connecting device when it is fitted and in a simple manner, provides comparatively narrow gaps between the connecting device and the housing.

A torsional rigidity and, if required, an improved positioning of the connecting device relative to the housing is also essentially provided here by a contact surface of the device body essentially extending tangentially which interoperates with a corresponding contact surface of the housing.

For a more precise definition of the position of the connecting device relative to the housing it is finally important, according to the invention, for the contact surface of the connecting device at areas of the contact surface tangentially opposite each other in relation to the insertion section to be embodied with a plastically deformable contact surface projection and/or for the area around the circumference of the insertion section to have a ring-shaped closed area of the cylindrical surface on which a number of elastic, springy, centering projections, projecting radially from the cylindrical surface are provided which are arranged at intervals from one another around the circumference. This allows a "tight-fitting" interoperation between the insertion section and the opening of the housing or between the corresponding contact surfaces and, therefore, a particularly precise definition of the position of the connecting device.

In a preferred embodiment, the device body includes a plastic part which embodies both the insertion section and the contact surface coherently in one piece. In addition to making the part simple to manufacture, this measure also, for example, has the advantage that the contact surface used to define the position, has a particularly precise position relative to the insertion section.

If the above-mentioned plastic deformable contact surface projections are provided on the contact surface of the connecting device, the contact surface is preferably embodied in such a way that it essentially only interoperates with the corresponding contact surfaces of the housing at the contact surface areas arranged tangentially opposite one another. As a result, optimum use is made of the advantageous action of the deformable projections.

If the area around the circumference of the insertion section has the above-mentioned circular, closed area of the cylindrical surface with the centering projections extending out from it, then these centering projections can, for example, be embodied identically and arranged equidistantly to one another around the circumference. This achieves particularly precise centering of the insertion section within the housing opening for example. In order to ensure that the insertion section is easy to introduce, it is advantageous for the centering projections to be provided with an insertion bevel in each case.

In a preferred embodiment, the insertion section essentially has a cylindrical contour. For example, the insertion section can include a "cylindrical bore" which is dimensioned in such a way that a minimum annular clearance to the inner wall of the axial opening remains in the housing. As a result, this comparatively small annular clearance then, for example, guarantees that the material is sealed against any encapsulation provided after the connecting device has been fitted. However, it is true that the liquid material (for example, plastic) used during the encapsulation process can penetrate to a certain extent into the annular clearance, but then it solidifies and in this way forms a barrier against further material penetration. Therefore, the minimum annular clearance guarantees an "automatic sealing" in the case of an coating process.

Particularly in order to achieve a good sealing effect the above-mentioned cylindrical bore should extend over a certain not inconsiderable axial distance, for example, over at least 20% of the axial length by which the insertion section penetrates into the axial opening of the housing. The radially projecting, but radially, elastically sprung centering projections, can be arranged in the axial area of the above-mentioned cylindrical bore or in the remaining axial area of the insertion section. In practice, the latter variant allows greater freedom in design of these centering projections. Therefore, in a preferred embodiment, provision is made for the insertion section to have the centering projections at its distal (free) end, whereas its proximal end area embodies the cylindrical bore which preferably has no centering projections.

In principle, the centering projections can be provided as separate components, for example, as elastic elements fitted subsequently to the insertion section or even provided as components manufactured in a two-component injection molding method together with the insertion section or with the entire device body.

However, in a preferred embodiment, the sprung centering projections are embodied in one piece with the material of the insertion section or the entire device body, for example, as sprung projections on a one-part plastic part. As a result, the sprung centering projections can, for example, be embodied in a simple way, essentially as extended material tongues projecting in the axial direction, however, with their free ends extending in a radial direction. However, from a manufacturing point of view, an embodiment is preferred for this, in which, the material of a cylindrical bore embodied at the proximal end of the insertion section, continues cylindrically to the distal end of the insertion section via a part of the circumference and via another part of the circumference deviating from the cylindrical shape embodying the radially projecting material tongues. In order to have as much axial length as possible made available for the embodiment of the sealing cylindrical bore, it is preferred here that the free ends of such material tongues extend up to the free end of the insertion section or extend just slightly further.

In an advantageous further development, the contour of the insertion section and particularly the area of the cylindrical surface of the above-mentioned "cylindrical bore" is tapered conically (tapered in the axial direction to the free end of the insertion section). As a result, the size of the annular clearance is, in practice, reduced further and in this way the sealing action thus achieved is increased further.

In order to bring about a simple and reliable interoperation of the corresponding contact surfaces when the insertion section is inserted into the opening of the housing, it is advantageous for at least one of the contact surfaces and/or one or more plastic deformable contact surface projections to be provided with an insertion bevel, if required.

One embodiment provides for the device body to include a plastic part (for example, the part mentioned above as well as the part embodying the insertion section and the contact surface), in the case of which the terminal pins, the contact parts for contacting the contact pins, as well as an electrical line arrangement between the terminal pins and the contact parts all forming an integral part. It is in particular possible for the entire connecting device to be made from one single plastic body with the above-mentioned molded parts.

In a preferred embodiment, contact parts for contacting the contact pins are embodied as solder tags which must be soldered onto the contact pins. Such solder tags are preferably arranged adjacent to the openings in such a way that they lie against the contact pins and in this way can be soldered particularly easily.

A preferred application of the connecting device is the electrical contacting of the contact pins of a piezoelectric actuator of the fuel injector of an internal combustion engine. The fuel injector involved can, for example, be a diesel injector of a storage injection system.

BRIEF DESCRIPTION OF THE DRAWINGS

Embodiments of the invention are explained below on the basis of the accompanying drawings and figures. They are as follows.

DETAILED DESCRIPTION OF THE PREFERRED EMBODIMENTS

Figure 1:
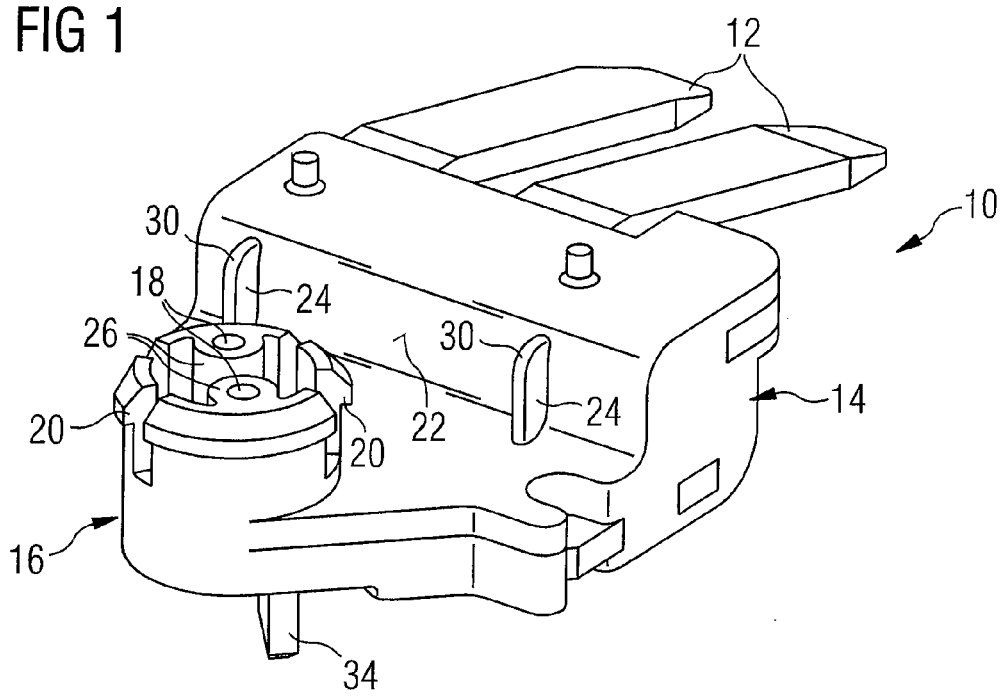
FIG. 1 is a perspective view from below at an angle of a contact tongue carrier according to the invention.
Figure 2:
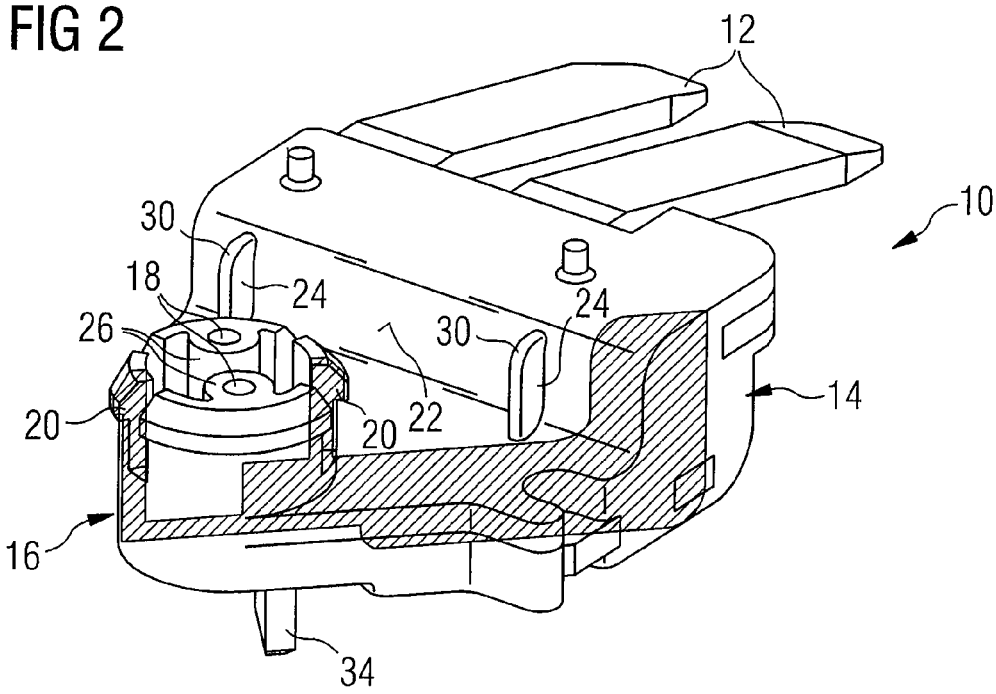
FIG. 2 is a perspective and part cross-sectional view from below at an angle of the contact tongue carrier.

FIGS. 1 and 2 both show a contact tongue carrier indicated by the number 10 (connecting device) for the electrical connection of the contact pins of a piezoelectric actuator (not shown) with contact tongues 12 (terminal pins) which form an integral part of a plastic body 14 and together with a (not shown) plastic coating embodying a connector of a fuel injector.

In the example shown, the body 14 is a plastic part manufactured in one piece and has an insertion section 16 with an overall cylindrical contour which is embodied to make it suitable for axial insertion into an axial opening of a sleeve-type housing of the fuel injector and is provided with openings 18 to enable the contact pins of the piezoactuator to pass through, and also a contact surface 22 arranged offset to the side relative to the insertion section 16 and essentially extending tangentially at a distance from the insertion section 16. The contact surface 22 interoperates in the way described below, after the contact tongue carrier 10 has been fitted, in which the insertion section 16 is inserted axially into the opening of the injector housing, with a corresponding contact surface of this injector housing to provide torsional stability. The contact surface 22 of the contact tongue carrier 10 has two contact surface areas arranged tangentially opposite one in relation to the insertion section 16, in which one of two plastically deformable contact surface projections 24, project from the plane of the contact surface 22 in each case.

In the example shown, these plastically deformable projections 24 are molded in one piece on the plastic body 14. When the insertion section 16 is introduced into the housing opening, the projections 24 can be deformed plastically by the corresponding contact surface provided on the housing so that at the end of the insertion procedure, the two corresponding contact surfaces in the area of the projections 24 fit tightly against one another.

In very general terms there are many possibilities for designing the plastically deformable contact surface projections 24. The projection 24 could also be embodied as a separate part attached to the contact surface 22 (instead of being molded in one piece).

This variant would then be particularly advantageous if the material used for the plastic body 14 is unsuitable for deformation.

Therefore, the projections 24 as shown in FIG. 2 are preferably embodied in the form of ribs and, in each case, have a rib extension extending away from the contact surface 22 which is connected via an insertion rounding or insertion bevel 30 to the rib section which is in effect during interoperation with the contact surfaces.

Also conceivable is the embodiment of a projection 24 made of a material selected for its ability to plastically deform in a two-component injection molding process together with the embodiment of the remainder of the plastic body 14.

The circumferential area of the insertion section 16 is formed by a cylindrical (or slightly conical) wall which is interrupted at two places which are diametrically opposite one another on which radial elastic, springy centering pins 20 are embodied. Therefore, by means of these centering pins 20, the insertion section 16 and, as a result, the entire contact tongue carrier 10 are arranged simply and reliably in a well-defined position referring to the housing. As a result, for this purpose, the free ends of these centering pins 20, project radially towards the outside (from the area of the cylindrical surface of the remaining insertion section).

In a variation of the embodiment shown, the centering pins 20 can also be embodied separately from the remaining material of the insertion section 16 or vary in their numbers and/or arrangement.

In order to simplify the introduction of the insertion section 16 into the opening of the housing, the insertion section 16 is provided with insertion bevels around its free end. As a result, in the embodiment shown, both the material areas continuing in the axial direction up the free end of the insertion section of the cylindrical section and the free ends of the centering pins 20 are also provided with insertion bevels.

In addition to the centering pin 20, the insertion section 16 also has two sleeves 26 which, in the example shown, are embodied in the same way as the centering pins 20, in one piece, with the remaining plastic body 14 and serve to guide and insulate the contact pins which must be contacted in the area of the insertion section 16.

During manufacturing of the contact tongue carrier 10, the contact tongues 12 which lead to solder tags 34, via an electrical line arrangement embodied in one piece (in the inside of the plastic body 14), form an integral part of the plastic material used to form the plastic body 14.

Therefore, when the contact tongue carrier 10 is fitted, the contact pins of the piezoactuator pass through the openings 18 and lie with their ends against the solder tags 34 arranged adjacent to these openings 18 so that the contact pins can be soldered easily in order to produce electrical contact with the solder tags 34.

Figure 3:
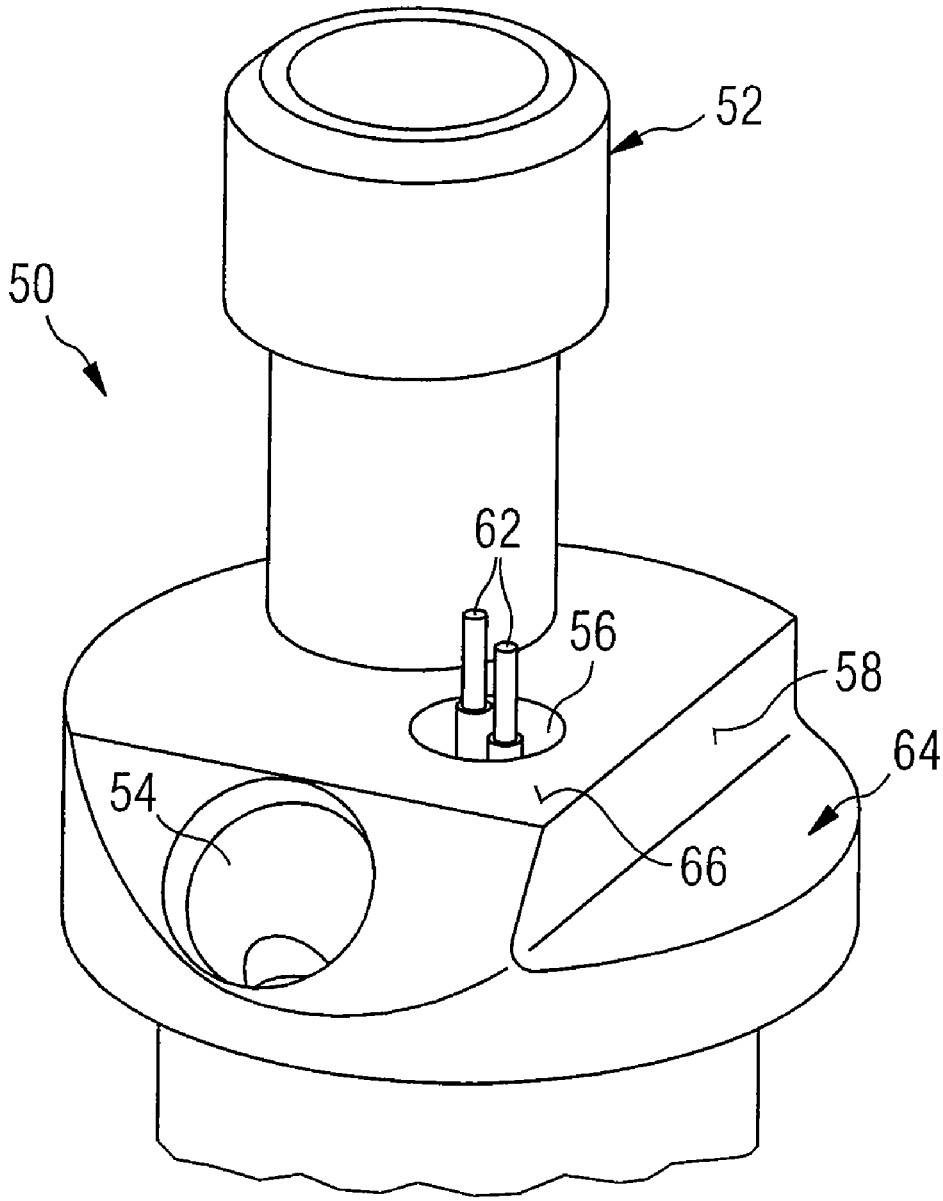
FIG. 3 is a perspective view of an upper end area of a housing of a fuel injector to be provided with the contact tongue carrier.

FIG. 3 shows the injector housing identified by the number 50 in its upper (away from the injection nozzle) area before the contact tongue carrier 10, which has been described above is fitted.

The injector housing 50 has a high-pressure fuel supply connection 52, as well as a fuel leakage connection 54 in order to supply with fuel a hydraulic fuel servo valve arranged in the bottom area of the housing 50 (not shown) in a known way which therefore requires no explanation here. Likewise, the servo valve is controlled by means of the piezoactuator arranged in the bottom area of the housing 50 and connected via an operative connection to an actuator of the servo valve.

In addition, FIG. 3 shows the axial opening 56 of the sleeve-type housing 50 from which the contact pins 62 of the piezoactuator protrude upwards after a piezoelectric assembly containing the piezoactuator has been inserted (from the bottom).

After the piezoelectric assembly has been fitted into the injector housing 50, the contact tongue carrier 10 described above with reference to FIGS. 1 and 2 is fitted from the top onto a contact surface 66 of the housing 50 provided with a recess 64 so that the contact pins 62 of the piezoactuator pass through the openings 18 of the insertion section 16 and can then be soldered onto the solder tags 34. In order to obtain as well-defined a position as possible of the fitted contact tongue carrier 10 in relation to the housing 50, the housing 50 has a contact surface 58 extending tangentially, which interoperates with the contact surface 22 of the contact tongue carrier 10, which has already been described above. In order to bring the corresponding contact surfaces 22, 58 in a simple and reliable way to the opposite contact surface, the housing 50 can be provided with an angular face adjacent to the contact surface 58.

Figure 4:
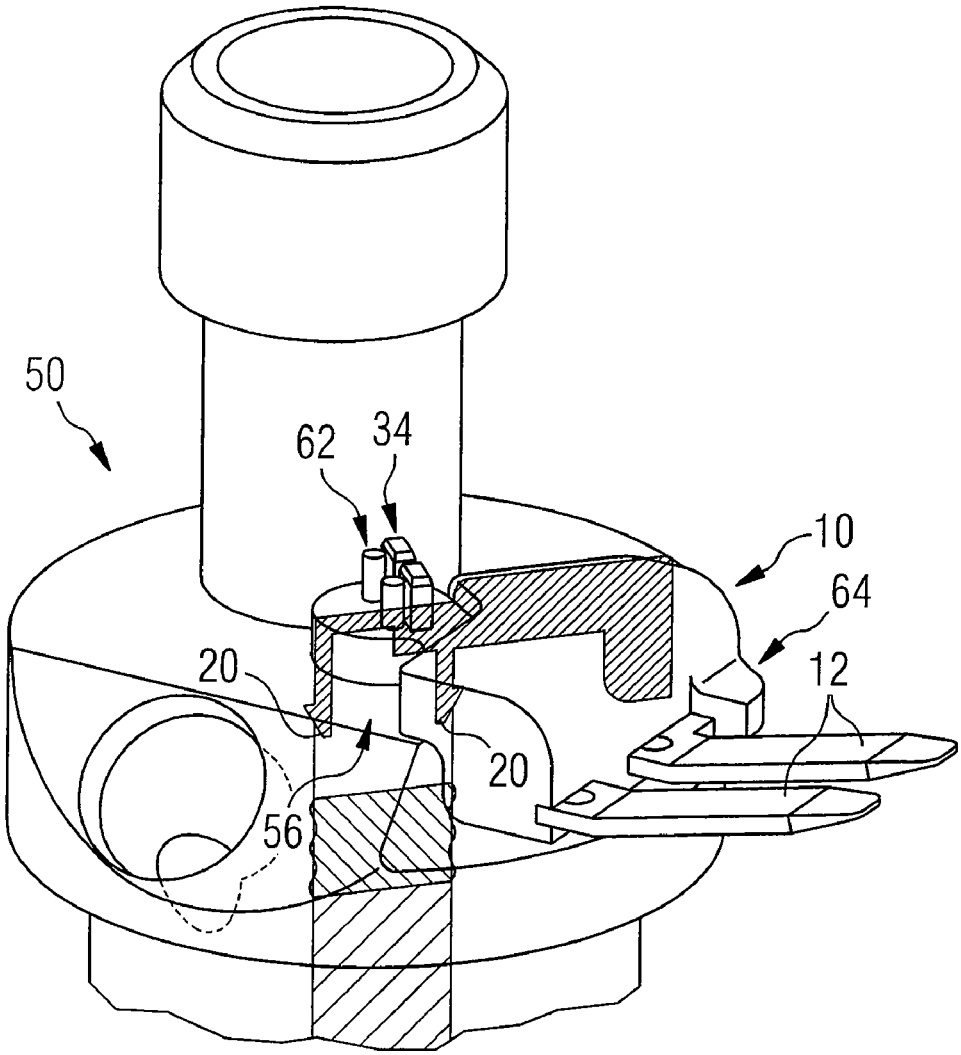
FIG. 4 is a perspective and part cross-sectional view of the injector housing with a fitted contact tongue carrier.

FIG. 4 shows the situation immediately after the contact tongue carrier 10 has been fitted onto the injector housing 50. In this situation, the contact pins 62 of the piezoactuator lie against the solder tags 34 and are soldered onto these. As a result, a plastic encapsulation at the end of the injector housing 50 shown embodies a plastic casing (not shown) which also provides a connector housing for the connector embodied by means of the contact tongues 12.

The limit stop between the contact tongue carrier 10 and the recess 64 in the injector housing 50 shown in this figure guarantees a torsional stability, whose stability and accuracy are considerably increased by providing the plastic deformable projections 24 as well as the radially, sprung centering pins 20.

In particular, in order to obtain a contact surface which is as good as possible between the solder tags 34 and the contact pins 62 of the piezoactuator as well as to obtain a contact surface which is as coaxial as possible of the insertion section 16 in the housing opening 56, the development of the contact surface 22 with the projections 24, on the one hand, and the insertion section 16 with the sprung pins 20, on the other hand, are of particular importance. Even if the solder tags are provided with a certain amount of production inaccuracy (tolerance), these can be brought reliably and stably to the contact surface with the contact pins.

Essentially interoperation of the contact surfaces 22 and 58 only takes place at the contact surface areas that are opposite one another, in which case the fixing implemented by means of the plastically deformed projections 24, positions the contact tongue carrier 10 and thereby its insertion section 16 reliably and accurately before the soldering process (and also before the plastic encapsulation).

The basic idea of the embodiment described above is to embody a contact tongue carrier which is used for the electrical contacting of the injector to the rest of the injection system, as regards achieving a well-defined position and fixing it. In particular the torsional stability is, in this case, implemented by a specific deformation of the contact surface projections embodied as compressed ribs on fitting the contact tongue carrier. An insertion section of the contact tongue carrier is centered and a well-defined contact position of the contact pins at the contact parts (solder tags) ensured by means of sprung centering elements which are arranged, for example, along the area of the cylindrical surface of a cylinder or a cone. As a result, the advantages are as follows:

- Minimizing the radial play of the contact tongue carrier on the injector housing with automatic centering of the insertion section.
- Avoiding a costly, additional manual positioning of the contact tongue carrier before encapsulation of the housing end on the connector-side.
- Optimizing the tolerance compensation of the geometry of the insertion section by means of centering elements which are embodied as springs.
- Optimizing the tolerance compensation of the contact surfaces when the contact tongue carrier is twisted on the injector housing.
- If the plastic deformable section or sections are directly integrated in a plastic body of the contact tongue carrier: Dispensing with the requirement for additional components.
- If a (for example, final) plastic encapsulation of the connector-side end is provided, any relaxation of the deformed section or sections that may occur over the service life of the injector does not play any role because the position of the components encapsulated with plastic, that is the contact tongue carrier element together with all the deformed sections when coating with plastic material are "frozen" in their position in any event.
- Simple implementation of a sealing of the housing opening against penetration of injection molding material during a (for example, final) encapsulation process.
- Minimizing the amount of bending required for the electrically conductive components of the connecting device and minimizing the position tolerances of the contact parts (for example, solder tags).

We claim:

1. A connecting device for electrical connection of contact pins which protrude from an axial opening of a sleeve-type housing, comprising:

a device body with an insertion section extending therefrom and configured for axial introduction into the axial opening;

the device body having openings for the contact pins to pass therethrough and having a contact surface arranged laterally offset from the insertion section and extending from the device body, the device body contact surface configured to interoperate with a corresponding contact surface of the housing to provide torsional stability;

the contact surface of the connecting device having a plastically deformable contact surface projection configured to interoperate with the corresponding contact surface of the housing; and the insertion section comprising a cylindrical surface having a circumference on which one or more centering projections, projecting radially from the area of the cylindrical surface are provided, arranged at intervals from one another around the circumference of the cylindrical surface.

2. The connecting device according to claim 1, wherein two plastically deformable contact surface projections are disposed on the contact surface of the connecting device and located opposite one another in relation to the insertion section.

3. The connecting device according to claim 1, wherein the centering projections are arranged equidistantly around the circumference.

4. The connecting device according to claim 1, wherein the centering projections each comprise an insertion bevel.

5. The connecting device according to claim 3, wherein the centering projections each comprise an insertion bevel in each case.

6. The connecting device according to claim 1, wherein the connecting body comprises a plastic molded part forming both the insertion section and the contact surface in one piece.

7. The connecting device according to claim 1, wherein the connecting body comprises a plastic molded part into which the terminal pins, contact parts for contacting the contact pins and an electrical line arrangement between the terminal pins and the contact parts are molded.

8. The connecting device according to claim 1, comprising solder tags arranged adjacent to the openings and configured to be soldered onto the contact pins.

9. A fuel injector for an internal combustion engine comprising:

a piezoelectric actuator in an actuator housing having contact pins contacted by a connecting device, the connecting device comprising:

a device body with an insertion section extending therefrom and configured for axial introduction into an axial opening of the actuator housing;

the device body having openings for the contact pins to pass therethrough and having a contact surface arranged laterally offset from the insertion section and extending from the device body, the device body contact surface configured to interoperate with a corresponding contact surface of the housing to provide torsional stability;

the contact surface of the connecting device having a plastically deformable contact surface projection configured to interoperate with the corresponding contact surface of the housing; and the insertion section comprising a cylindrical surface having a circumference on which one or more centering projections, projecting radially from the area of the cylindrical surface are provided, arranged at intervals from one another around the circumference of the cylindrical surface.

10. The fuel injector according to claim 9, comprising a plastic encapsulation which forms a casing on the connector-side end of the fuel injector.

11. A method comprising the step of using a connecting device according to claim 1 for the electrical contacting of the contact pins of a piezoelectric actuator of a fuel injector of an internal combustion engine.

* * * * *